US005092599A

United States Patent [19]

Okumoto et al.

[11] Patent Number: 5,092,599

[45] Date of Patent: Mar. 3, 1992

[54] WOOD GOLF CLUB HEAD

[75] Inventors: Takaharu Okumoto, Chigasaki; Tatsuo Nishimoto, Hiratsuka, both of Japan

[73] Assignee: The Yokohama Rubber Co., Ltd., Tokyo, Japan

[21] Appl. No.: 510,242

[22] Filed: Apr. 17, 1990

[30] Foreign Application Priority Data

Apr. 30, 1989 [JP] Japan ..... 1-45677[U]
Sep. 29, 1989 [JP] Japan ..... 1-252223

[51] Int. Cl.[5] ..... A63B 53/04
[52] U.S. Cl. ..... 273/167 E; 273/164
[58] Field of Search ..... 273/167 E, 164, 167 R, 273/167 D, 167-175, 183 D, 193 R, 186 R; D21/214

[56] References Cited

U.S. PATENT DOCUMENTS 4,431,152 2/1984 Stuff ..... 273/167 E
4,754,974 7/1988 Kobayashi ..... 273/167 E
4,900,029 2/1990 Sinclair ..... 273/167 E

FOREIGN PATENT DOCUMENTS 52-538 1/1977 Japan ..... 273/167 E

OTHER PUBLICATIONS

"Golf Digest" Magazine, Sep. 1982 Issue, p. NE7.

*Primary Examiner*—Edward M. Coven
*Assistant Examiner*—Sebastiano Passaniti
*Attorney, Agent, or Firm*—Finnegan, Henderson, Farabow, Garrett & Dunner

[57] ABSTRACT

A wood golf club head equipped with steps which extend transversely on an upper surface of the head or a single large dimple of specific dimensions and location that extends over the rear portion of the upper surface of the club head.

3 Claims, 6 Drawing Sheets

WOOD GOLF CLUB HEAD

BACKGROUND OF THE INVENTION

This invention relates to a wood golf club head and more particularly to a wood golf club head which improves the driving or flying distance of a hit ball and its directionality.

A golf club encounters air resistance when it is swung at the time of hitting of a ball and this results in the drop head speed and in a occurrence of irregular vibration of the club's shaft. The drop of the head speed in turn reduces the flying distance of the hit ball and irregular vibration of the club shaft effects directionality of the hit ball. Such phenomena occur particularly in a wood golf club head having a large club head and this tendency becomes all the more remarkable in those wood golf clubs whose head size becomes greater with a recent trend longer club shafts.

An analysis made by the inventors of the present invention reveals that the phenomena described above are mainly caused by layer separation of the air flow that flows on an upper surface side of the club head as shown in FIG. 13 of the accompanying drawings. FIG. 13 shows the air flows Q that occur around a wood golf club head 1 when it is swung from the left to the right in the drawing. The air flow Q flows in a direction relatively opposite to the moving direction of the wood golf club head 1, strikes a face 2 on the front surface of the club head 1, and is divided vertically into air flows Qa on the upper side surface 3 and air flows Qa on the sole side 4. Of these air flows, the air flow Qa flowing on the sole keeps the state side keeps the state is laminar because the sole surface is substantially horizontal but the air flow Qa flowing on the upper surface side undergoes layer separation of its laminar portion in the front half region of the upper surface 3 and generates large turbulent flows at the back of the position of the layer separation as shown in the drawing because the radius of curvature of the surface in the front half portion of the club head is greater than that of the sole. These large turbulent flows increase the air resistance to the wood golf club head 1 and greatly change the pressure distance between the upper surface side 3 and the sole side 4, thereby causing irregular vibration of the club's shaft.

SUMMARY OF THE INVENTION

An object of the present invention is to provide a wood golf club head which either prevents layer separation of the air flow occurring on the upper surface of the club head or moves backward as much as possible the point where laminar separation being so as to prevent a drop in head speed and irregular vibration of the club shaft.

In order to accomplish the object described above, in the wood golf club head in accordance with the present invention, steps extending in a transverse direction are disposed on the upper surface which extends rearwardly in an arcuate form from the upper edge of the face on the front surface. The steps can be formed typically by a stripe-like projection or groove extending in the transverse direction on the upper surface of the golf club head. The object described above can also be accomplished by forming a dimple having a region which expands rearwardly from a position spaced apart rearwardly by a predetermined distance from the highest point of the upper surface on the upper surface and forming the step by the front edge portion of this dimple.

The step described above generates minute eddy flows in the air flow flowing on the upper side surface of the golf club head and these minute eddy flows prevent layer separation of the laminar flow portion of the air flow from the upper surface or greatly moves back the point of layer separation. Since a large tubulent flow does not occur in this manner, the air resistance to the golf club head decreases and the fluctuation of the pressure difference between the upper surface and the sole is reduced.

DESCRIPTION OF THE PREFERRED EMBODIMENTS

Figure 1:
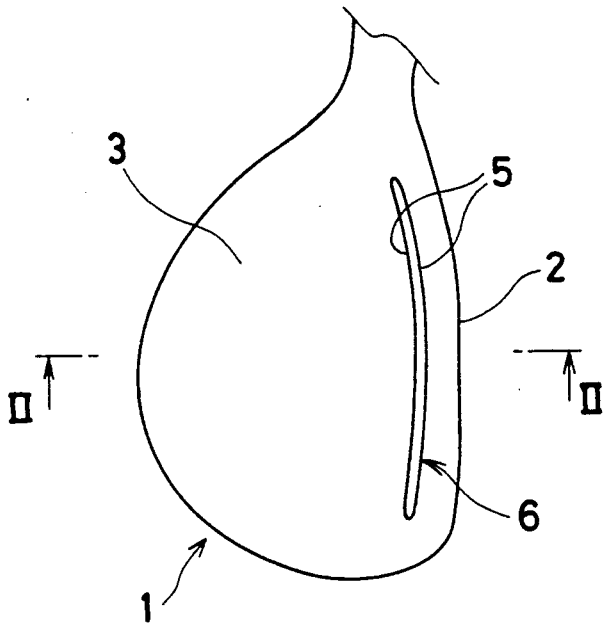
FIG. 1 is a plan view of a wood golf club head in accordance with an embodiment of the present invention.
Figure 2:
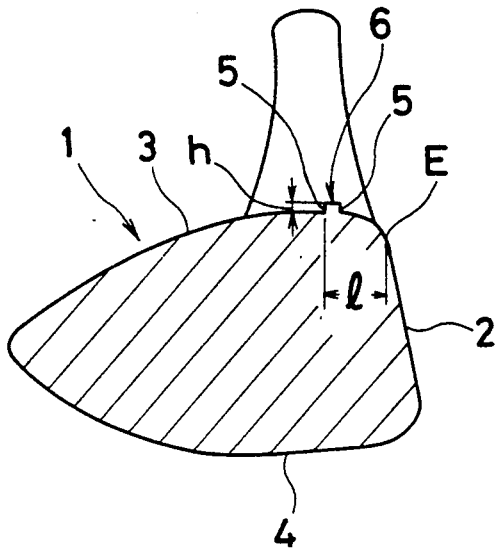
FIG. 2 is a sectional view taken along line II—II of FIG. 1.

In the wood golf club head shown in FIGS. 1 and 2, reference numeral 2 represents a face for hitting the ball which is formed on the front surface of the club head 1. An upper surface 3 is formed in such a manner as to extend rearward from the upper edge of the face 2 in an arcuate form and a sole 4 is formed in such a manner as to extend rearward and substantially in a planar form from the lower edge of the face 2. A stripe-like projection 6 is formed on the upper surface 3 in such a manner so that it extends across substantially the full range of its transverse direction and in conformity with the planar shape of the face 2. Two steps 5, 5 are formed at the front and rear sides of this projection 6. Such a projection 6 is preferably disposed across substantially the full width of the upper surface 3 but it may be partially interrupted, whenever necessary.

Figure 3:
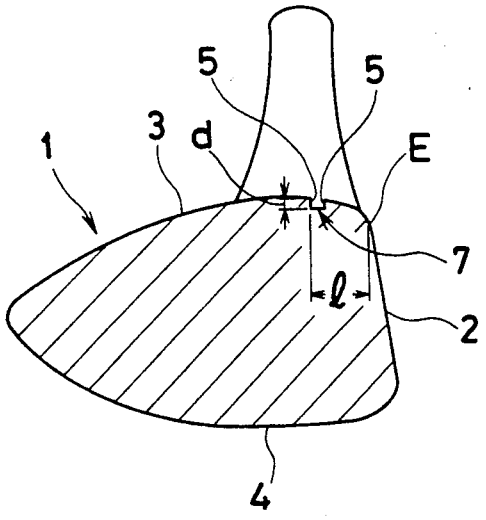
FIG. 3 is a sectional view of a wood golf club head in accordance with another embodiment of the present invention and corresponds to FIG. 2.
Figure 4A:
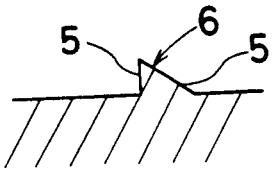
FIGS. 4A to 4G are sectional views showing different shapes of steps, respectively.
Figure 4B:
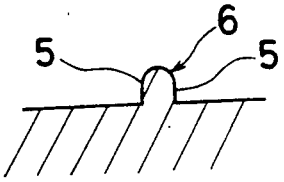
Figure 4C:
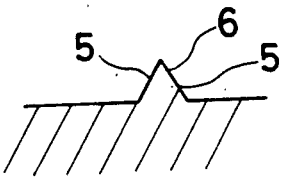
Figure 4D:
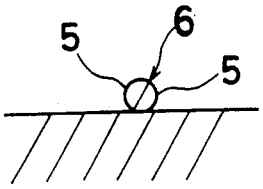
Figure 4E:
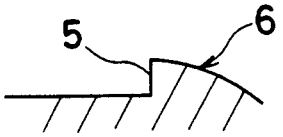
Figure 4F:
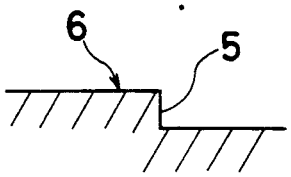
Figure 4G:
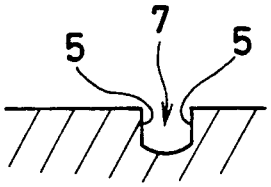

The projection 6 described above may be replaced by a groove 7 as shown in FIG. 3. This groove 7 is preferably disposed in such a manner as to also extend across substantially the full range of the transverse direction of the upper surface 3 and along the planar shape of the face 2 in the same way as the projection 6 described above. Two steps 5, 5 are formed in this groove 7 in the same way as the projection 6 described above.

When a player swings a wood golf club head equipped with the projection 6 or groove 7 having these steps 5, minute eddy flows occur on the downstream side of the projection 6 or groove 7 as shown in FIGS.

10 and 11. The minute eddy flows function in such a manner as to prevent the laminar flow portion of those air flows Qa, which branch on the upper surface 3, from separating from the upper surface 3. In other words, the eddy flows prevent layer separation or moves the position, at which great layer separation otherwise occurs, to a more rearward position, and prevents the occurrence of a large turbulent flow.

In order to generate most effectively the effect described above, the projection 6 or the groove 7 described above exists preferably within the range of a distance l (See FIGS. 2 and 3) of approximately 20 mm at the back of the top edge E in view of the fact that the head speed time from swing of the golf club by ordinary golfers is within the range of about 35 to about 45 m/sec. Further, the height h of the projection 6 from the upper surface 3 or the depth d of the groove 7 from the upper surface 3 is preferably within the range of 0.5 to 2.0 mm. Here, the term "top edge E" represents the boundary where the face 2 and the upper surface 3 merge with each other.

The shapes of the projection 6 and groove 7 are not particularly limited to those described above, and various modified forms such as shown in FIGS. 4A to 4G, for example, can be employed.

Figure 5:
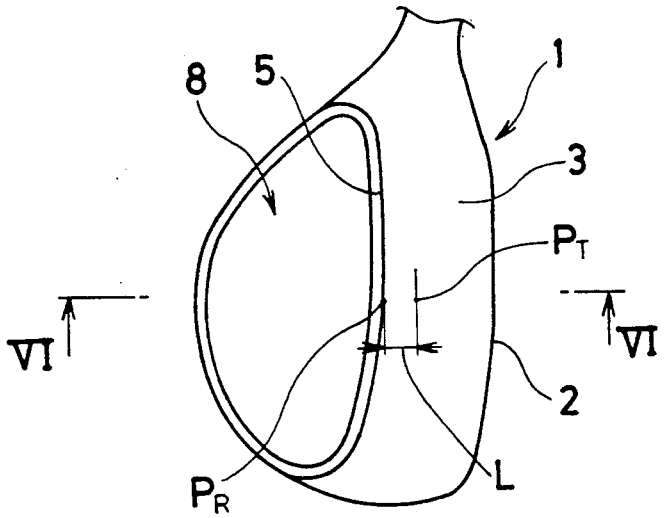
FIG. 5 is a plan view of a wood golf club head in accordance with still another embodiment of the present invention.
Figure 6:
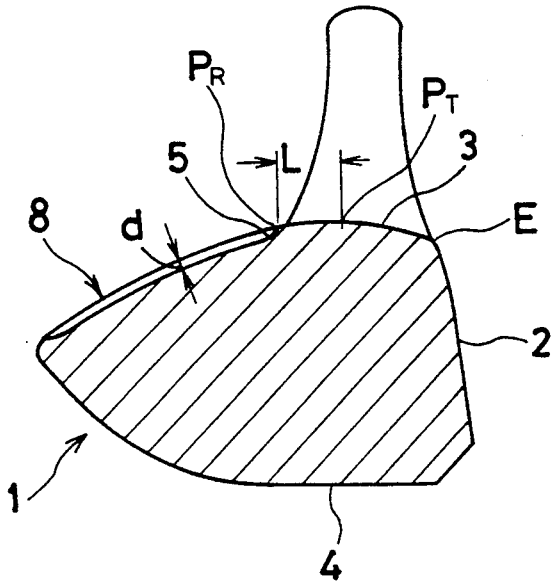
FIG. 6 is a sectional view taken along line VI—VI of FIG. 5.

FIGS. 5 and 6 show another embodiment of the present invention.

Figure 12:
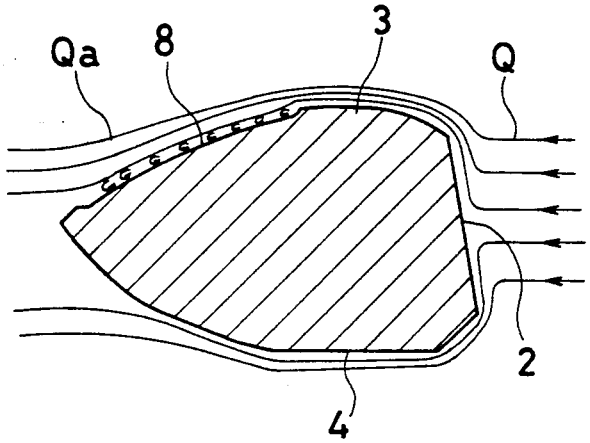
Figure 13:
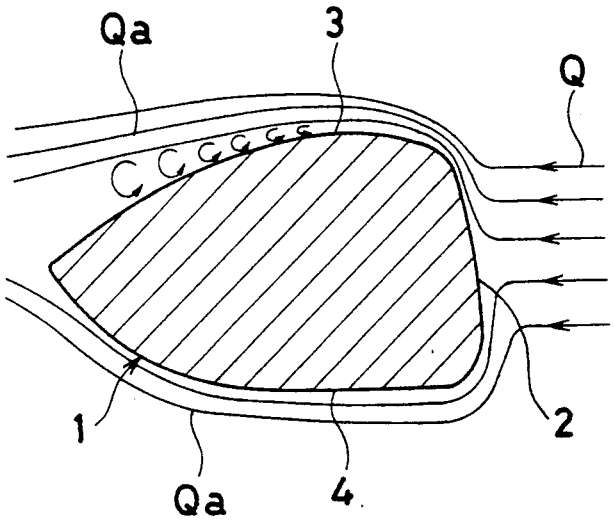
FIG. 13 PRIOR ART
FIG. 13 is an explanatory view showing the air flow occurring with a conventional wood golf club head.

In the wood golf club head 1 of this embodiment, a dimple 8 is formed on the rear half portion of the upper surface 3 and the step 5 is formed on the front edge side of this dimple 8. The step 5 at the front edge portion generates the minute eddy flows such as those shown in FIG. 12 and provides the effect of the present invention in the same way as described above.

Figure 7:
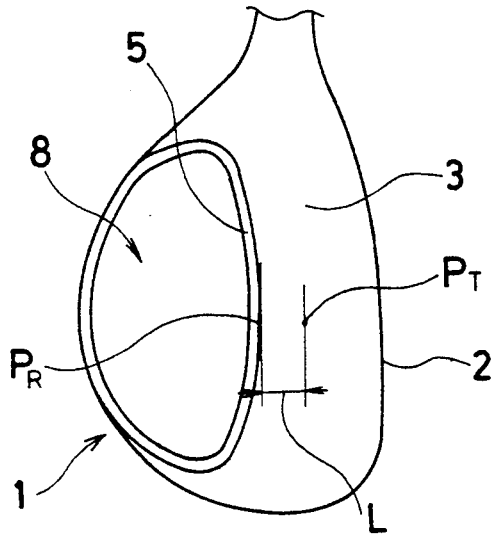
FIGS. 7 to 9 are plan views of wood golf club heads in accordance with other embodiments of the present invention and correspond to FIG. 5, respectively.
Figure 8:
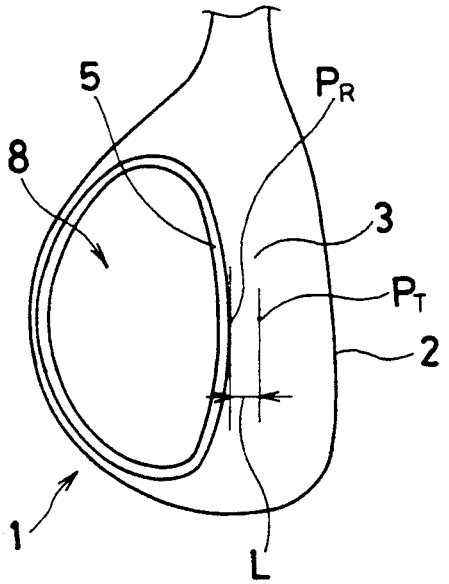
Figure 9:
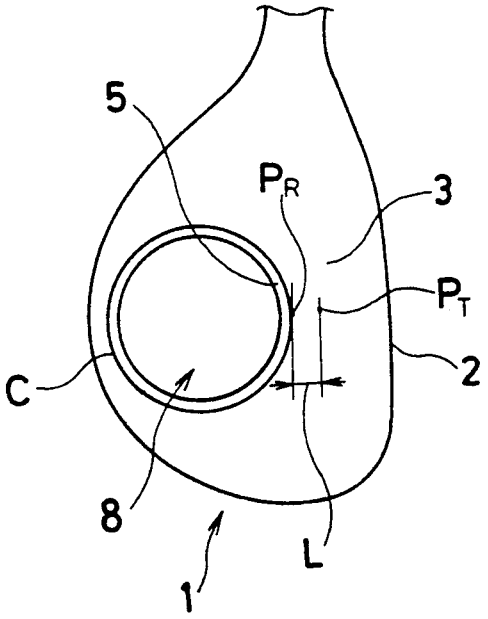
Figure 10:
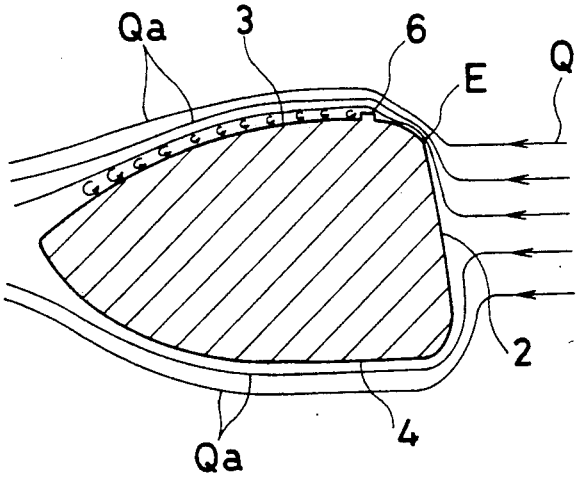
FIGS. 10 to 12 are explanatory views showing the air flow that occurs with the wood golf clubs of the present invention.
Figure 11:
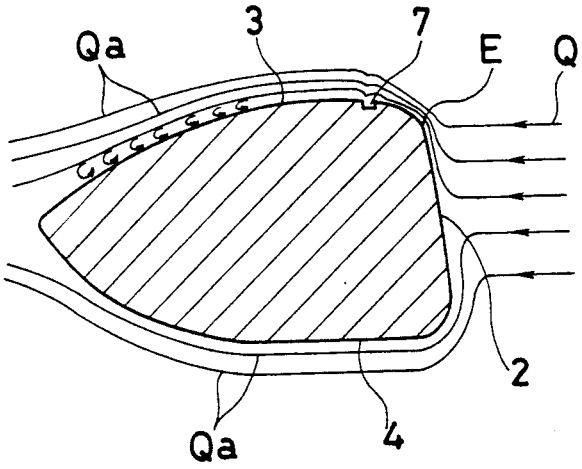

This dimple 8 is designed to have a relatively greater area than the groove 7 of the embodiment described above and is positioned more rearward than the groove 7. In other words, the position of the dimple 8 starts at a position $P_R$ which is spaced apart rearward by a distance L from the apex $P_T$ of the arcuate curve surface of the upper surface 3, and it is recessed with a large area at that position. A preferred area of this dimple 8 is at least the area of a circle C having as its diameter a distance from the position $P_R$ near to the rearmost position of the upper surface 3 and is at most the area of an ellipse formed by expanding the circle C described above to the maximum extent in the transverse direction. The dimple 8 of the wood golf club head 1 shown in FIGS. 7 and 8 has an area which is in between the areas of the dimples shown in FIGS. 5 and 9.

In order to generate effectively the effect brought forth by the step 5 of such a dimple 8, L described above is preferably within the range of 10 to 20 mm in view of the fact that the head speed at the time of swing of the golf club by ordinary golfers is within the range of about 35 to about 45 m/sec, and the depth d of the dimple is preferably within the range of from 0.5 to 1.5

The wood golf club head in each of the embodiments described above may be made of a wood or of fiber-reinforced plastics or a metal. Though not shown in the drawings of the embodiments, a cavity can be disposed inside the wood golf club head and a weight for balance adjustment can be partially packed after a foamed body is packed into the cavity.

In the wood golf club head in accordance with the present invention described above, the step disposed on the club head upper surface generates the minute eddy flows in the air flow branched on the upper surface and prevents the separation of the laminar flow portion of the air flow from the upper surface or moves back the point of layer separation. Accordingly, the wood golf club head of the present invention prevents drops in head speed at the time of swing and irregular vibration of the club's shaft.

What is claimed is:

1. A wood golf club head comprising:

a face for hitting a ball on a front surface of said wood golf club head;

a sole surface extending rearwardly from a lower edge of said face;

an upper surface extending rearwardly from an upper edge of said face and having a convex curved shape with an apex and an exposed single dimple spread out over a rear portion of the upper surface of the head, said dimple beginning at a point from 10 to 20 mm rearwardly from the apex of said curved upper surface, having a depth from said upper surface of from 0.5 to 1.5 mm and extending rearwardly at least over an area equivalent to the area of a circle having a diameter equal to the distance from said beginning point to a point adjacent a rearmost edge of said upper surface.

2. The wood golf club head of claim 1, wherein the dimple forms a circle.

3. The wood golf club head of claim 1, wherein the dimple has an elliptical shape having a front edge extending generally parallel to the upper edge of the face and extending over most of the rear portion of the upper surface of the club head rearwardly of said front edge of the dimple.

* * * * *